United States Patent [19]

Suzuki

[11] 4,132,475

[45] Jan. 2, 1979

[54] SHEET ADVANCING AND POSITIONING DEVICE

[75] Inventor: Tomio Suzuki, Aichi, Japan

[73] Assignee: Minolta Camera Kabushiki Kaisha, Osaka, Japan

[21] Appl. No.: 815,741

[22] Filed: Jul. 14, 1977

[30] Foreign Application Priority Data

Jul. 23, 1976 [JP] Japan ..... 51-97602[U]

[51] Int. Cl.[2] ..... G03G 15/00

[52] U.S. Cl. ..... 355/3 R; 271/4; 271/229; 355/8

[58] Field of Search ..... 355/3 R, 8, 16, 18, 355/133; 271/4, 42, 128, 130, 182, 229, DIG. 3

[56] References Cited

U.S. PATENT DOCUMENTS

| | | | |
|---|---|---|---|
| 3,503,677 | 3/1970 | Uchiyama | 355/13 |
| 3,637,303 | 1/1972 | Komori et al. | 355/8 |
| 3,782,715 | 1/1974 | Norgaard et al. | 271/57 |
| 3,792,924 | 2/1974 | Matsuda et al. | 355/16 X |

*Primary Examiner*—R. L. Moses

*Attorney, Agent, or Firm*—Wolder, Gross & Yavner

[57] ABSTRACT

An apparatus for advancing a sheet and stopping it in a predetermined position including: a mechanism for transporting the sheet along a predetermined path and releasing the transporting force from being transmitted to the sheet in the course of advance; an insulating member positioned in the transporting path; and a charging device for charging the insulating member. The charging device charges the insulating member prior to the passing of the sheet over the insulating member by being transported by the transporting means. In addition, the transporting force is released from the sheet prior to the passing of the trailing edge of the sheet over the insulating member thus charged thereby precisely stopping the sheet in said predetermined position due to the electrostatic attracting force produced between the insulating member thus charged and the sheet.

14 Claims, 14 Drawing Figures

SHEET ADVANCING AND POSITIONING DEVICE

BACKGROUND OF THE INVENTION

The present invention relates generally to improvements in a stop-position limiting devices for sheet-like materials advanced along a predetermined path by transport means, and it relates more particularly to a stop-position limiting device of the above type, which includes transport or feed means which releases the transporting force from being transmitted to the advancing sheet-like material while the transporting means remains in a transporting condition.

There has long been a demand in many fields of industry for a stop-position limiting device to stop a sheet-like article in a desired position along a transporting path, by releasing the advancing force from being transmitted to a sheet-like article during its advance along such path by transporting or conveying means.

To meet this demand, there has been proposed a device, in which, as shown in FIG. 1, there is provided a friction member such as of rubber, that may be displaced between a storage or stack position A of the sheet-like articles, and a predetermined terminal position C, and the friction member is so actuated as to be swung downwards by means of a suitable swinging mechanism to contact the top surface of the uppermost sheet-like article, thereby causing the top sheet-like article to advance in the direction of the arrow, after which the friction member is swung upwards at a stop portion B so as to release a transporting force from being transmitted to the article, thereby allowing the movement of the friction member alone, to the terminal position C. Another attempt proposed as transporting means is such that the sheet-like article is carried on a belt conveyed to the stop position Y. Still another proposed mechanism operates such that a sheet-like article is transported by a roller engaging the undersurface of the sheet-like article or a pair of upper and lower rollers engaging the top face and undersurface of the sheet-like article to advance the article to a stop position. In either case, the transporting means is not provided with means for forcibly or positively stopping the sheet-like article at a predetermined position, but only releases the transporting force from being transmitted to the article. As a result, in the event that the transporting speed is increased, then the sheet-like article does not immediately stop upon release due to its momentum, but stops beyond the position where the transmission of the transporting force is released. In this case, the ultimate stop position deviates from the proper predetermined position in a range of 2 to 10 mm, when the sheet-like article is transported at a speed of 90 mm/sec. As a consequence, means for forcibly or positively stopping the sheet-like article in the precise position is dictated. The simplest positive stopping means may be an engaging shoulder portion provided on the transporting path, or a stop pin located in the transporting path. However, when a sheet-like article is further advanced from its stop position in the transporting direction, the aforesaid shoulder portion or pin is an obstacle to the advance of the sheet-like article.

SUMMARY OF THE INVENTION

It is accordingly a principal object of the present invention to provide a positive stop device for an advancing sheet which is devoid of the aforesaid drawbacks and disadvantages and obviates the need for any positive sheet advancing obstacle of the above nature.

According to the present invention, there is provided a sheet position limiting device which comprises transport means for advancing a sheet along a predetermined path, an electrically insulating member lying in the sheet advancing path, and means for charging the insulating member prior to the passing of the sheet over the insulating member, the sheet advancing force of the transport means being released from being transmitted to the sheet, prior to the passing of the trailing edge of the sheet-like material or over the charged insulating member, so that the sheet which is moving along the transporting path thereof is forcibly and positively stopping in a predetermined position due to an electrostatic attracting force produced between the aforesaid charged insulating member and the sheet, thereby eliminating any obstacles to hinder the subsequent further advance of the sheet in the transporting direction from the aforesaid stop position. Thus, the sheet-like material stop-position limiting device according to the present invention is highly useful in an electrphotographic reproducing apparatus, in which a charger for forming an electrostatic latent image on a photosensitive sheet may be used for charging the aforesaid insulating member, and yet a sheet-like article may be delivered from the stop position to the subsequent step in a simple manner, thus providing many advantages in practical applications.

BRIEF DESCRIPTION OF THE DRAWINGS

FIGS. 2 through 13 are views illustrating a preferred embodiment of the present invention, shown as applied for an electrophotographic reproducing apparatus in which FIG. 2 is a longitudinal cross-sectional view of the reproducing apparatus prior to the commencement of exposure;

FIG. 3(*a*) is a partial view of the device prior to the commencement of exposure and charging;

FIG. 3(*b*) is a partial view of the device, showing the position where the sheet advance has been completed;

FIG. 4 is a longitudinal cross-sectional view showing the condition of the apparatus upon completion of the aforesaid charging;

FIG. 5 is a view similar to FIG. 4 but at the completion of the aforesaid exposure;

FIG. 6 is a side view showing a cam plate on the exposure deck;

FIG. 7 is a top view of the cam plate;

FIG. 8 is a side view illustrating the advancing lever swinging mechanism;

FIG. 9 is a top view of the swinging mechanism;

FIG. 10 is a side view illustrating the swinging mechanism in the exposure and charging starting position;

FIG. 11 is a side view illustrating the swinging mechanism in its exposure completed condition;

FIG. 12 is a side view illustrating the return stroke of the exposure box; and FIG. 13 is a perspective view illustrating the drive mechanism for the exposure box.

DESCRIPTION OF THE PREFERRED EMBODIMENT

Figure 1:
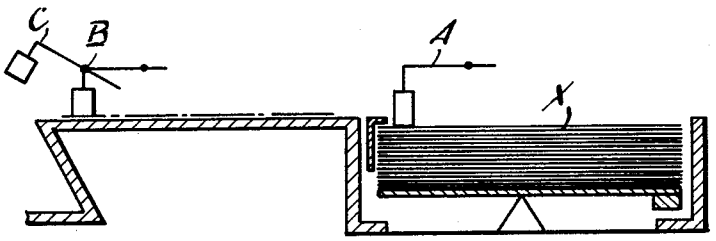
FIG. 1 is a longitudinal cross-sectional view of one example of a sheet transportation system lacking the positioning means of the present invention in which a sheet is transported by a transport means and a transporting force is released from the sheet in the course of the transportation.

Referring now to the drawings, particularly FIGS. 2 to 13 which show a preferred embodiment of the present invention, the improved stop-position limiting device is illustrated as used in an electrophotographic reproducing apparatus of the type in which a photoconductive layer on a copy sheet (photosensitive sheet) is uniformly charged so as to be rendered photosensitive, after which a light image of an original is projected thereon to form an electrostatic image on the sheet.

Figure 2:
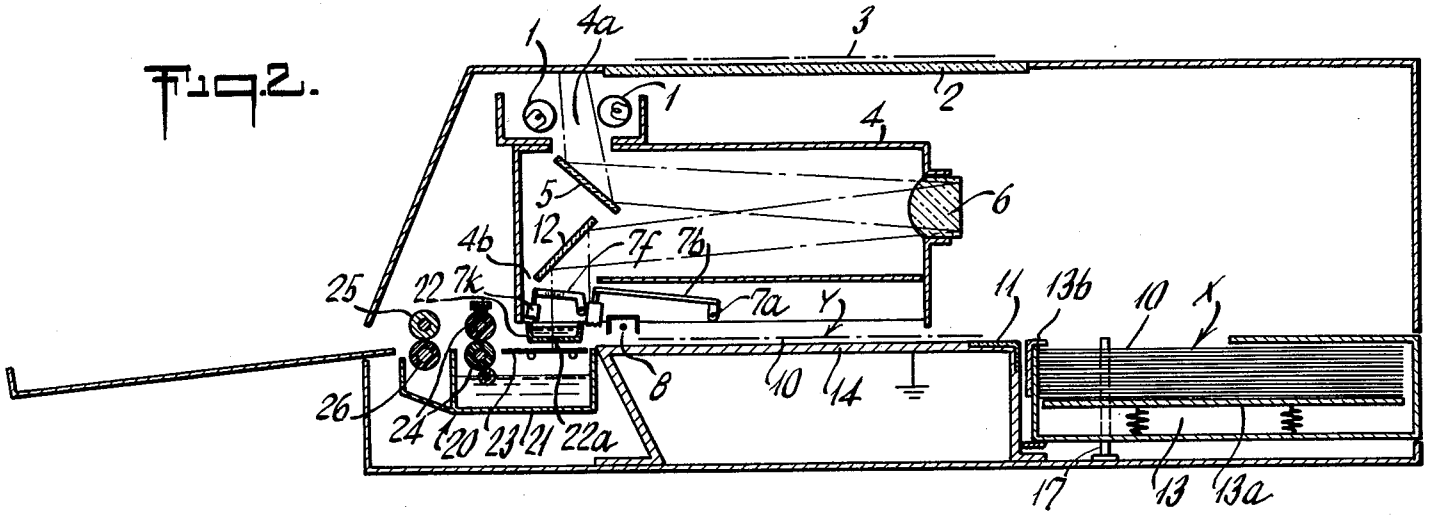

The entire reproducing apparatus in its starting condition is shown in FIG. 2 and includes a glass plate 2 on which an original 3 is to be carried. Glass plate 2 is provided on the top surface of the reproducing apparatus.

Figure 13:
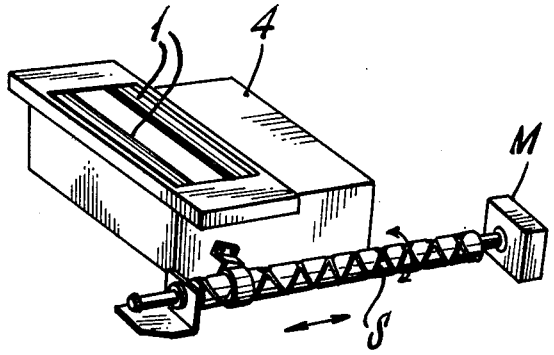

Shown at 4 is an exposure box which may be moved in opposite directions in parallel with and beneath the surface of glass plate 2 by drive means S for example in the form of an opposite threaded traverse drive screw adapted to be reversible in rotation and being directly connected to a motor M as shown in FIG. 13. Exposure box 4 is provided with light source 1 for illuminating the original 3, window 4*a*, through which the light from original 3 passes, first mirror 5, mirror lens 6, and second mirror 12, which are used for projecting the light image of the original onto a photosensitive or copy sheet 10 to be described hereinafter. A slit 4*b* is provided in exposure box 4 on the side confronting a photosensitive sheet. Shown at 14 is an exposure deck consisting of an electrically conductive plate made of a metal, such as aluminum, and deck 14 is positioned in parallel with glass plate 2 under the reproducing apparatus.

Shown at 13 is a cassette, in which unexposed photosensitive copy sheets 10 are stacked on a supporting plate 13*a*. Cassette 13 is provided on its front surface with a corner separator 13*b*. The plate 13*a* moves upward under the action of underlying compression springs as the sheets are consumed and the leading tip of top photosensitive sheet 10 is so designed and disposed as to be maintained in contact with the undersurface of corner separator 13*b*.

Cassette 13 is so constructed as to be positioned in a manner that the top photosensitive sheet 10 may move linearly onto the exposure deck 14.

Figure 9:
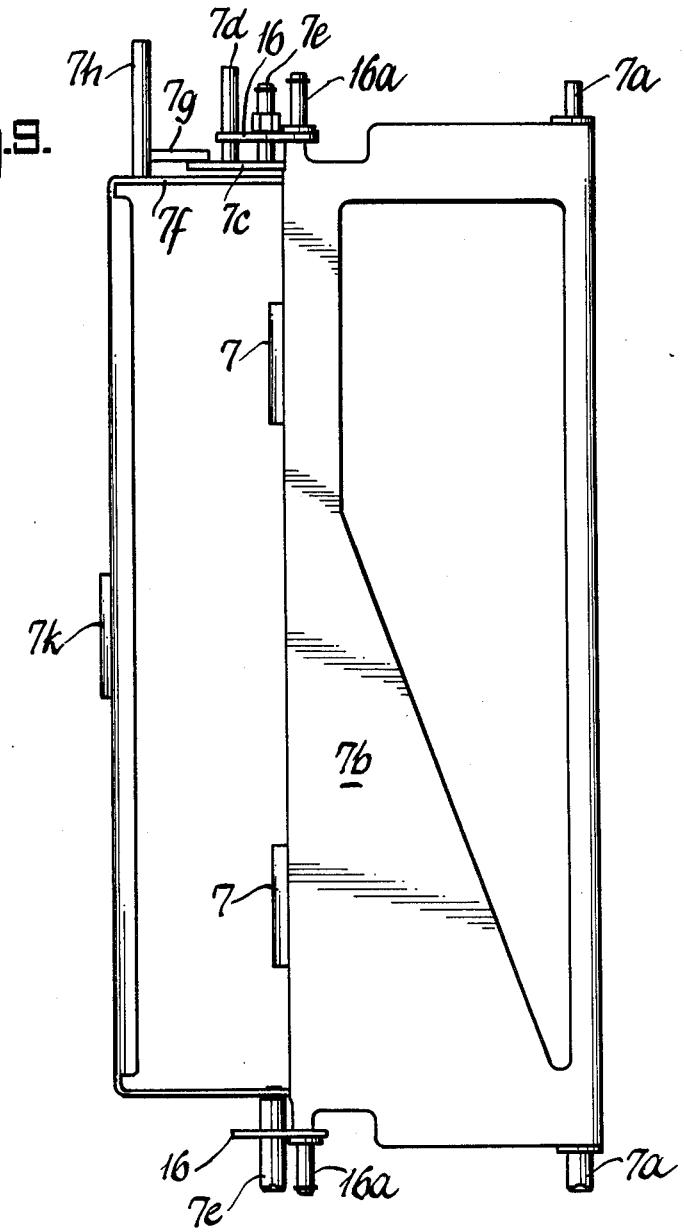

There is provided a liquid developing means 20 for visualizing the electrostatic latent image on a photosensitive sheet with toner in the known manner. Positioned above developing tank 21 are a liquid-developer-supply trough 22 having slit 22*a* in its bottom portion, and a grid 23 for guiding the advancing photosensitive sheet 10. Shown at 24 are a pair of squeezer rollers for removing excess liquid developer from the developed photosensitive sheet, at 25 a blotting roller for drying the photosensitive sheet, and at 26 a discharge roller which is urged toward engagement with blotting roller 25. Thus, a photosensitive-sheet-transport path is defined by supply dish 22, grid 23, pair of squeezer rollers 24, blotting rollers 25, and discharge roller 26, and is so designed as to be positioned in a manner to allow a linear movement of a photosensitive sheet 10 on the exposure deck 14. In other words, the top photosensitive sheet 10 in cassette 13 may linearly move to blotting roller 25 which is the final step. Positioned under the exposure box 4 proximate its leading border in the positional relationship as shown are a charger 8 of know construction serving as a charging means, and longitudinally spaced pairs of pivots 7*a*, 7*e* trailing charger 8. Swinging levers 7*b*, 7*f* having the shapes shown in FIG. 9 and tending to be rotated in the counterclockwise direction (downwards) by their weight are rotatably supported by pivots 7*a*, 7*e*. Provided on the tip portion of lever 7*b* in the positional relationship shown in FIG. 9 is a pair of transversely spaced resilient friction transporting rubbers 7 serving as a transporting member adapted to transmit a transporting force to a photosensitive sheet 10, when in engagement or contact therewith. On the other hand, the outer edge of lever 7*f*, as shown in FIG. 9, is provided with a discharge rubber 7*k* adapted to discharge photosensitive sheet from exposure deck 14, by engaging and pushing the trailing edge of a photosensitive sheet. Shown at 11 is an electrostatic-attracting-insulating plate made of an insulating material such as teflon, which is provided at the right-hand or trailing end of exposure deck 14. Plate 11 functions as to stop an unexposed photosensitive sheet 10 transported from cassette 13, in a given position Y on exposure deck 14 by means of electrostatic attraction.

In the stationary or rest condition of the reproducing apparatus, exposure box 4, charger 8 and transporting rubber 7 assume the sheet-feeding-completed positions as shown in FIG. 3(*b*), the transporting rubber 7 at this time being positioned above the level of exposure deck 14 by means of swinging lever 7*b*.

Figure 4:
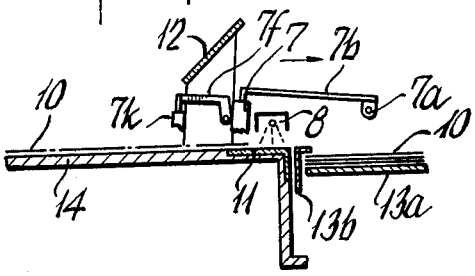

Upon commencement of a reproducing cycle, exposure box 4, charger 8 and transporting rubber 7 are all moved about 30 mm to the left. When charger 8 comes to a starting position (FIG. 2) i.e., to the left or leading edge of a photosensitive sheet 10 disposed at its stop position on exposure deck 14, then light source 1 and charger 8 are energized and the exposure box 4 moves to the right for scanning the original 3, whereby photosensitive sheet 10 is charged, and then original 3 is exposed and an image thereof projected onto photosensitive sheet 10 thus charged, so that an electrostatic latent image is formed on the photosensitive sheet 10. When exposure box 4 further continues to move to the right as shown in FIG. 4, so that charger 8 comes to the right-hand or trailing edge of photosensitive sheet 10, then charger 8 charges the right-hand edge of photosensitive sheet 10, in addition to the insulating plate 11 partially underlying photosensitive sheet 10.

Figure 5:
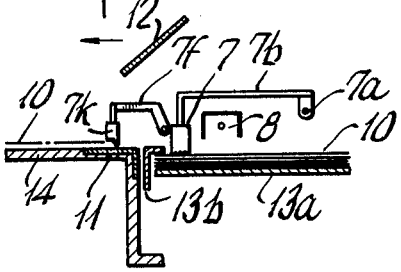

Then, charger 8 is deenergized, and moves to the right along with exposure box 4, the exposure box 4 moving until it completes exposure at the right-hand edge of sheet 10 resting on exposure deck 14, light source 1 is extinguished in the position shown in FIG. 5, and the movement of exposure box 4 to the right is stopped. At this time, swinging lever 7*b* is swung by means of a mechanism to be described later, so that transporting rubber 7 and discharge rubber 7*k* provided on second swinging lever 7*f* adapted to swing in association with transporting rubber 7 are lowered. Thus, transporting rubber 7 engages the top surface of unexposed photosensitive sheet 10 within a cassette, while discharge rubber 7*k* engages exposure deck 14 rearwardly or beyond the trailing edge of exposed photosensitive sheet 10 on exposure deck 14.

Figure 6:
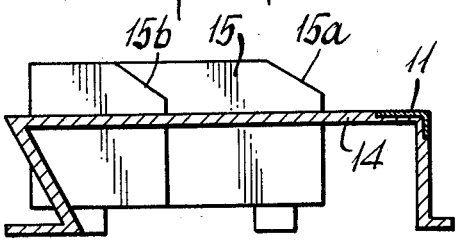
Figure 7:
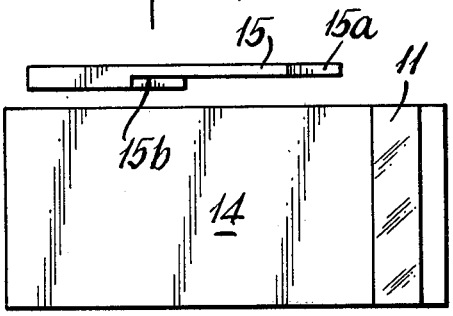
Figure 8:
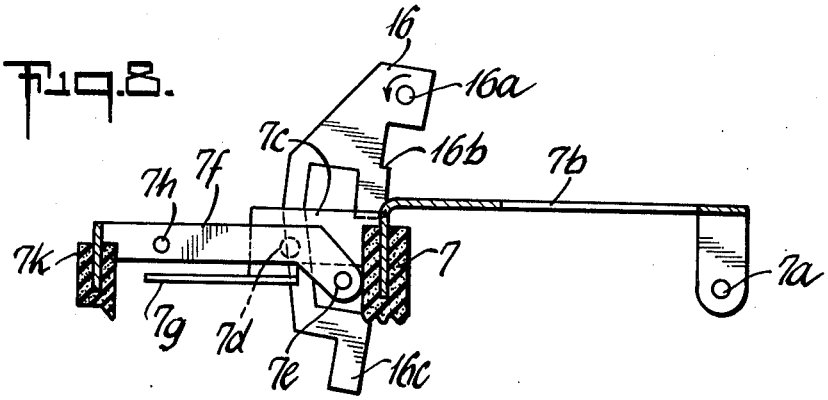

Considering now the lever, a swinging mechanism and the operation of swinging levers 7*b*, 7*f*, a cam plate 15 is provided in a desired position of the reproducing apparatus transversely outside of exposure deck 14 and extends longitudinally in the moving direction of exposure box 4. Cam plate 15 is formed with cams 15*a*, 15*b* in the form of inclined edges or surfaces, as shown in FIGS. 6 and 7. As shown in FIGS. 8 and 9, swinging lever 7b is formed with a longitudinally projecting portion 7c on its front side, and a first follower defining operating pin 7d is mounted to projecting portion 7c in a manner to be engageable with cam 15b. Swinging lever 7b is further formed with an operating plate 7g projecting forwardly.

Swinging lever 7f engages operating plate 7g to rotate swinging lever 7f in the clockwise direction and is formed with a second follower defining operating pin 7h thereon, which is engageable with cam 15a. A lock plate 16 is provided on exposure box 4 and is rotatably supported by pivot 16a, and tends to rotate in the direction of the arrow by its weight. Lock plate 16 is formed with jaw portion 16b adapted to engage a bent portion of swinging lever 7b, when swinging lever 7b is lifted by means of cam 15b of plate cam 15.

Figure 3B:
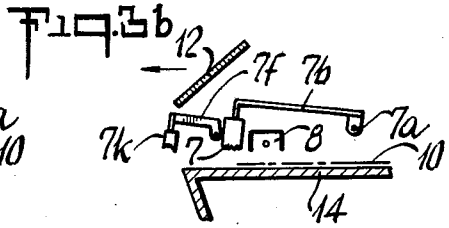
Figure 3A:
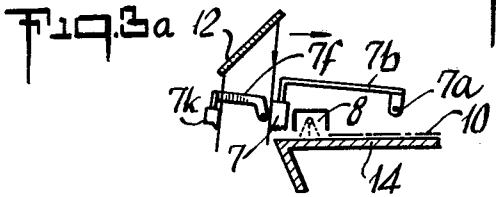
Figure 10:
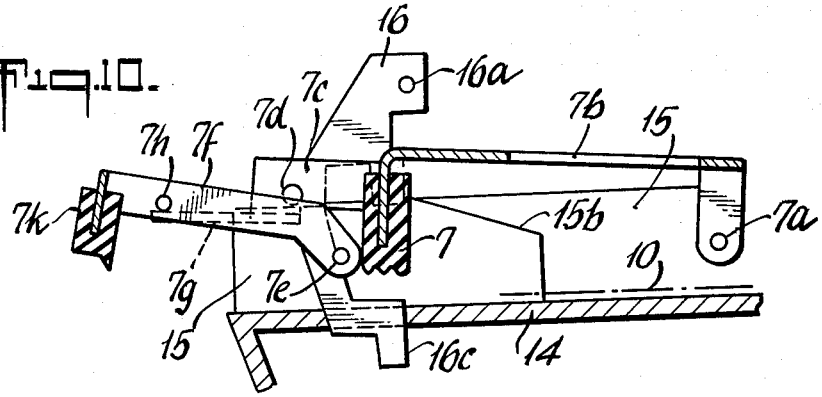
Figure 11:
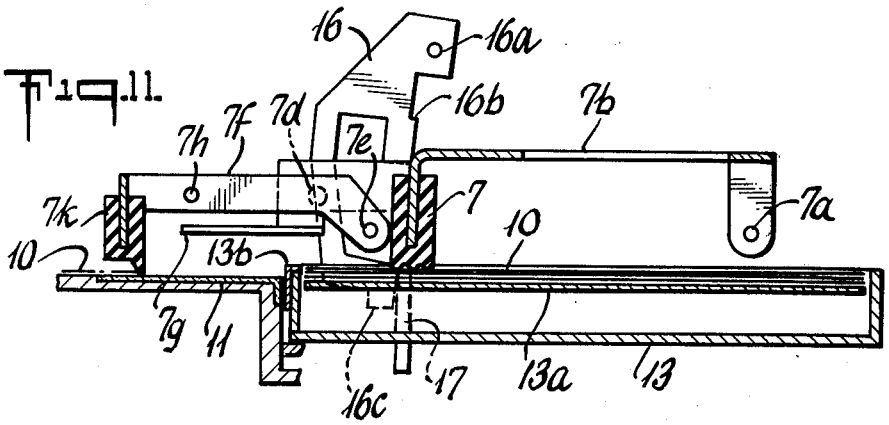

In the sheet feeding completed position and charge starting position of the apparatus, as shown in FIGS. 3(a) and (b), first operating pin 7d and second operating pin 7h are positioned on plate cam 15, so that as shown in FIG. 10, swinging lever 7b and swinging lever 7f both remain in their raised positions having been rotated in the clockwise direction. In this respect, swinging lever 7b is locked in raised position by jaw portion 16b of lock plate 16, and the swinging lever 7f is locked in the aforesaid raised position by means of operating plate 7g of swinging lever 7b, the transporting rubber 7 and discharge rubber 7k both being thus maintained in their raised positions. Accordingly, even if charging and exposure of photosensitive sheet 10 on exposure deck 14 proceeds, and first and second operating pins 7d, 7h are disengaged from cam plate 15, the rubbers 7 and 7k may both maintain their raised positions. However, when the exposure to photosensitive sheet 10 is completed, and an electrostatic latent image corresponding to the original is formed, then as shown in FIG. 11, lock plate 16 engages locking plate 17 provided in a desired position of the reproducing apparatus on a scanning path of the lock plate 16 outside the cassette 13, so that lock plate 16 is rotated in the clockwise direction against gravity, jaw portion 16b thereof is disengaged from swinging lever 7b, the swinging lever 7b is rotated in the counterclockwise direction by gravity, and the transporting rubber 7 engages the left, top surface of unexposed photosensitive sheet 10 stacked in cassette 13.

Simultaneously therewith, swinging lever 7f, as well, is released from its locked condition due to operating pin 7h being released from operating plate 7g, so as to rotate in the counterclockwise direction by gravity to bring discharge rubber 7k into engagement with exposure deck 14 outside the trailing edge of the exposed photosensitive sheet 10 on the exposure deck 14.

Under such a condition, when the exposure box 4 is moved to the left, then transporting rubber 7 transports the top photosensitive sheet 10 stacked in cassette 13 from cassette 13 on to exposure deck 14. On the other hand, discharge rubber 7k pushes exposed photosensitive sheet 10 on exposure deck 14, to the left, so as to bring the leading edge of the sheet 10 into the grid 23 in the developing means 20, whereupon an electrostatic latent image on photosensitive sheet 10 is visualized with toner with the aid of a liquid developer flowing through slit 22a in liquid-developer trough 22. Then, the leading edge of photosensitive sheet 10 which has passed over grid 23 is nipped between and advanced by squeezer rollers 24, then dried by the combination of blotting roller 25 and discharge roller 26, and then discharged.

Figure 12:
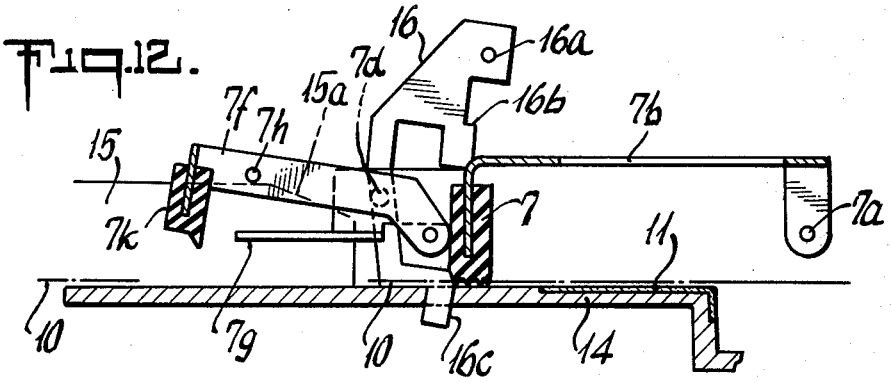

After the leading edge of the photosensitive sheet has been nipped between squeezer rollers, cam 15a causes swinging lever 7f to swing in the clockwise direction through the medium of the second operating pin 7h, thereby lifting discharge rubber 7k from exposure deck 14. However, the first operating pin 7d on the swinging lever 7b has not yet come to the position to engage cam 15b, so that transporting rubber 7 pushes photosensitive sheet 10 to the left, as shown in FIG. 12.

On the return stroke of exposure box 4, when a photosensitive sheet 10 comes to a given position on exposure deck 14, then first operating pin 7d is raised by means of cam 15b of plate cam 15, so that swinging lever 10 is rotated in the clockwise direction, thereby releasing photosensitive sheet 10 from being transported to the left by means of transporting rubber 7.

At this time, photosensitive sheet 10 tends to move to the left due to its inertia or momentum. However, since the trailing edge of photosensitive sheet 10 remains on the insulating plate 11 which has been previously electrostatically charged, sheet 10 is captured by its electrostatic attracting force so as to rapidly stop in a precise predetermined position.

The test results reveal that when the exposure box 4 is moved to the left at a speed of 90 mm/sec on its return stroke, and hence even if photosensitive sheet 10 is transported at the same speed as above, the photosensitive sheet 10 is precisely stopped in a given position, the positional deviation thereof being within 1 mm.

In the overall operation of the apparatus described above, upon commencement of the reproducing operation, the drive means (traverse drive screw) S rotated by the motor M transports the exposure box 4 to a starting position (FIG. 2). When the exposure box 4 reaches the starting position, it actuates a first suitably positioned microswitch (not shown). By the actuation of the first microswitch, reverse rotation of the motor M, lighting of light source 1 and charging of charger 8 are simultaneously started (FIG. 3(a) ). The exposure box 4 is transported to the right by the reverse rotation of the drive means S and when it comes to a position shown in FIG. 4, it actuates a second suitably positioned microswitch (not shown) by the actuation of which the charger 8 only is turned off. When the exposure box 4 reaches the position shown in FIG. 5, it actuates a third suitably positioned microswitch (not shown) by whose actuation the light source 1 is extinguished and the motor M is rotated reversely. Locking plate 17, as shown in FIG. 2, is located just before the position where the exposure box 4 actuates the third microswitch, so that the lock plate 16 is consequence engages the locking plate 17 as shown in FIG. 11. The exposure box 4 is transported to the left from the position shown in FIG. 5 by the second reverse rotation (normal rotation) of the drive means. The cam surface 15a of cam plate 15 as shown in FIG. 6 is so provided, that, immediately after the leading edge of an exposed photosensitive sheet 10 has been nipped between squeezer rollers 24, the cam 15a engages the second operating pin 7h of swinging lever 7f, so that, when the discharge rubber 7k of the swinging lever 7f is lifted by the cam surface 15a, as shown in FIG. 12, the exposed photosensitive sheet 10 is transported by the squeezer rollers 24. When the exposure box 4 reaches the position shown in FIG. 3(b), it actuates a microswitch (not shown) for stopping rotation of the motor M. The cam surface 15b of cam plate 15, as shown in FIG. 6 is so provided, that, just before the exposure box 4 actuates the stopping microswitch, the cam 15*b* engages the first operating pin 7*d* of swinging lever 7*b* and the trailing edge of the photosensitive sheet 10 has not passed beyond the insulating member 11 and partially overlaps the insulating member 11 as shown in FIG. 2. The liquid developer supply dish 22 is replenished with liquid developer from the developing tank 21 by suitable feed means, for example, a suitably connected pump and pipe (not shown).

While there has been described and illustrated a preferred embodiment of the present invention, it is apparent that numerous alterations, omissions and additions may be made without departing from the spirit thereof.

I claim:

1. An apparatus for advancing a web along a predetermined path and stopping it in a predetermined position comprising:

a transport means for advancing a web along a predetermined path under the influence of a transporting force;

an electrically insulating member positioned on said path;

charging means for charging said insulating member prior to the passing of said web over the insulating member by said transport means; and releasing means for releasing said transporting force from being transmitted to said web prior to the passing of the trailing edge of said web over the insulating member charged by said charging means, whereby said web advancing along said path is forcibly stopped in said predetermined position due to the electrostatic attracting force between said charged insulating member and said web.

2. An apparatus as claimed in claim 1, further comprising:

drive means for reciprocating said transport means between a start position where said transporting force is transmitted to said web and a stop position where the transporting force transmitted to said web is released.

3. An apparatus as claimed in claim 2, wherein said charging means is movable together with said transport means by said drive means, and when said charging means has moved to said start position from said stop position, said charging means charges said insulating member as it passes over said insulating member.

4. An apparatus as claimed in claim 1, further comprising:

a second transport means for transporting said web which is forcibly stopped in said predetermined position to a following position along said predetermined path.

5. An apparatus as claimed in claim 1, wherein said transporting means comprises a lever swingable between raised and lowered positions and having a rubber transport member which contacts said web when said lever is in lowered position, and means for moving said swingable lever in the advance direction along said predetermined path.

6. An apparatus as claimed in claim 1, wherein said insulating member and said charging means extend perpendicularly across said predetermined path.

7. An electrophotographic reproducing apparatus including the apparatus as claimed in claim 6, wherein said lever moving means includes an exposure box rotatably supporting said swinging lever, and drive means for moving said exposure box and said swing lever in the advance direction along said predetermined path.

8. An apparatus as claimed in claim 5 wherein said releasing means comprises a cam member for raising said swingable lever out of engagement with said web.

9. A device for advancing a sheet along a predetermined path to a predetermined position along said path comprising an electrostatically charged member located in said path, and means for advancing a sheet along said path and releasing said sheet from the advancing force of said advancing means proximate said predetermined position and proximate said charged member; said charged member having a sufficient charge to rapidly stop said sheet at said predetermined position upon the release thereof from said advancing force and against the momentum of the released advancing sheet under the influence of the electrostatic attraction between said charged member and said sheet.

10. The device of claim 9 wherein said charged member includes an insulating member extending across said predetermined path and comprising means for electrostatically charging said insulating member.

11. The device of claim 10 comprising a sheet support member having a top face delineating said predetermined path, said advancing means comprising a first engaging member reciprocatable along said path between advanced leading and retracted trailing positions and movable between a sheet engaging depressed position along said path during said advanced movement and a raised sheet release position proximate the leading border of said top face and during the retraction movement of said first engaging member.

12. The device of claim 11 wherein said insulating member is disposed along the trailing border of said top face.

13. An electrophotographic copying apparatus including a sheet support member having a top face delineating a predetermined path, means for supporting an original above said sheet support member top face, a carriage located between said top face and said original support means and longitudinally reciprocable along said top face, original illumination means carried by said carriage, optical scanning means carried by said carriage for scan projecting an image of said original onto a sheet located on said sheet support face, charging means carried by said carriage for charging said sheet prior to the exposure thereof to said image, and a mechanism for advancing a sheet to a predetermined position along said predetermined path comprising an insulating member extending across said predetermined path along the trailing border of said top face and electrostatically charged by said charging means, and means for advancing a sheet along said path and releasing said sheet from the advancing force of said advancing means proximate said predetermined position and proximate said insulating member, said charged insulating member having a sufficient charge to rapidly stop said sheet at said predetermined position upon the release thereof from said advancing force and against the momentum of the released advancing sheet under the influence of the electrostatic attraction between said charged insulating member and said sheet, said advancing means including a first engaging member reciprocable along said path between advanced leading and retracted trailing positions and movable between a sheet depressed position along said path during said advance movement and a raised sheet release position proximate the leading border of said top face and during the retraction movement of said first engaging member.

14. The apparatus of claim 13 including a second sheet engaging member carried by said carriage forwardly of said first sheet engaging member and being substantially concurrently movable therewith.

* * * * *